US008893931B2

(12) United States Patent
Mizushima

(10) Patent No.: US 8,893,931 B2
(45) Date of Patent: Nov. 25, 2014

(54) FOAM DISPENSER

(75) Inventor: Hiroshi Mizushima, Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 0 days.

(21) Appl. No.: 13/997,852

(22) PCT Filed: Jan. 27, 2012

(86) PCT No.: PCT/JP2012/000541

§ 371 (c)(1),
(2), (4) Date: Jun. 25, 2013

(87) PCT Pub. No.: WO2012/105207

PCT Pub. Date: Aug. 9, 2012

(65) Prior Publication Data

US 2013/0292420 A1 Nov. 7, 2013

(30) Foreign Application Priority Data

Jan. 31, 2011 (JP) ..... 2011-019065

(51) Int. Cl.

*B67D 7/76* (2010.01)
*B05B 7/00* (2006.01)
*B05B 11/00* (2006.01)

(52) U.S. Cl.

CPC ..... *B05B 7/0025* (2013.01); *B05B 7/0037* (2013.01); *B05B 11/0005* (2013.01); *B05B 11/0089* (2013.01); *B05B 11/3004* (2013.01); *B05B 11/3069* (2013.01); *B05B 11/3087* (2013.01)

USPC ..... 222/190; 222/108; 222/321.9

(58) Field of Classification Search

CPC .. B05B 7/0018; B05B 7/005; B05B 11/0016; B05B 11/0021; B05B 11/3066; B05B 11/3087; B05B 7/0037; B05B 11/3069; B05B 11/3004; B05B 7/0025; B05B 11/0089; B05B 11/0005; A47K 5/14

USPC ..... 222/190, 108, 320–321.9, 383.1, 385; 239/110, 120, 333

See application file for complete search history.

(56) References Cited

U.S. PATENT DOCUMENTS 5,307,962 A * 5/1994 Lin ..... 222/321.9
5,443,569 A * 8/1995 Uehira et al. ..... 222/190

(Continued)

FOREIGN PATENT DOCUMENTS

JP U-62-127955 8/1987
JP A-08-230961 9/1996

(Continued)

OTHER PUBLICATIONS

Apr. 10, 2012 International Search Report issued in International Application No. PCT/JP2012/000541.

(Continued)

*Primary Examiner* — Patrick M Buechner
(74) *Attorney, Agent, or Firm* — Oliff PLC

(57) ABSTRACT

Provided is a foam dispenser in which upward and downward displacement of an actuator causes a content liquid within a liquid cylinder and air within an air cylinder to be mixed and foamed, such that the foam so generated is dispensed from an outlet of a dispenser head. The dispenser head has a structure with a minimized thickness to thereby increase the dispensing amount. The dispenser head includes two members, i.e., a first member and a second member, that have special configuration for allowing the two members to be easily removed from a die and formed in a small thickness.

12 Claims, 6 Drawing Sheets

(56) References Cited

U.S. PATENT DOCUMENTS

| | | | | |
|---|---|---|---|---|
| 6,308,865 | B1 * | 10/2001 | Lin | 222/153.13 |
| 8,028,861 | B2 * | 10/2011 | Brouwer | 222/190 |
| 2007/0045350 | A1 * | 3/2007 | Lin | 222/321.9 |
| 2008/0237265 | A1 * | 10/2008 | Brouwer | 222/190 |
| 2009/0212074 | A1 * | 8/2009 | Brouwer | 222/190 |
| 2010/0108722 | A1 * | 5/2010 | Canfield et al. | 222/402.12 |
| 2011/0168739 | A1 * | 7/2011 | Brouwer | 222/190 |
| 2011/0284586 | A1 * | 11/2011 | Kerr et al. | 222/190 |
| 2011/0284587 | A1 * | 11/2011 | Galazka et al. | 222/190 |
| 2012/0205399 | A1 * | 8/2012 | Lane et al. | 222/190 |
| 2013/0048755 | A1 * | 2/2013 | Uehira et al. | 239/318 |

FOREIGN PATENT DOCUMENTS

| | | |
|---|---|---|
| JP | A-10-324357 | 12/1998 |
| JP | A-2005-66577 | 3/2005 |

OTHER PUBLICATIONS

Office Action issued in Canadian Application No. 2,823,583 issued Mar. 13, 2014.

Jun. 24, 2014 Office Action issued in Korean Patent Application No. 10-2013-7016737 (with English translation).

* cited by examiner

FOAM DISPENSER

TECHNICAL FIELD

The present invention relates to a foam dispenser.

BACKGROUND ART

Various types of foam dispensers have been proposed which includes a cylinder member suspended in a container body, the cylinder member having an upper large-diameter cylinder and a lower small-diameter cylinder. An upwardly-urged actuator is provided to project from the cylinder member, and a foaming member is fitted into the actuator. In this instance, depression of the actuator causes a content liquid within the small-diameter cylinder and air inside the large-diameter cylinder to pass through the foaming member so as to be foamed and discharged from a nozzle. (Refer to Patent Literature 1, for example.)

Manufacturing of such a conventional foam dispenser requires first of all a simple die structure for molding, and therefore, it has been a conventional practice that a dispenser head constituting an upper end of the actuator is formed as a single part with a large thickness.

CITATION LIST

Patent Literature

PTL 1: JPH08230961A

SUMMARY OF THE INVENTION

Technical Problems

Due to the above reason, the conventional foam dispenser suffers from a problem that the liquid passage and other elements are restricted in size, and a large outlet cannot be achieved without significantly enlarging the dispenser head itself and thereby increasing the manufacturing cost.

The present invention has been conceived in view of these problems and aims to provide a foam dispenser which makes it possible to realize a dispenser head structure with a minimum thickness to thereby increase the dispensing amount.

Solution to Problems

A first aspect of the present invention resides in a foam dispenser, comprising: a cylinder member B that includes: an upper end portion adapted to be secured to a placing cap A fitted over an outer circumference of a neck 101 of a container body 100 so that the cylinder member B is suspended in the container body 100; a large-diameter air cylinder 20; and a small-diameter liquid cylinder 21 provided concentrically with and below the large-diameter air cylinder 20; and an actuator C that includes: a stem 30; a liquid piston 35 protruding from a lower portion of a circumference of the stem 30 and adapted to slide in the liquid cylinder 21; an air piston 40 linked to the outer circumference of the stem 30 and adapted to slide in the air cylinder 20; and a dispenser head 50 fitted over an upper end of the stem 30, the actuator C being urged upward and adapted to be displaceable upward and downward such that the upward and the downward displacement of the actuator C causes a liquid within the liquid cylinder 21 and air within the air cylinder 20 to be mixed and foamed to be dispensed as a foam from an outlet of the dispenser head 50; wherein the dispenser head 50 comprises two members in the form of a first member 50*a* and a second member 50*b*, the first member 50*a* including: a top plate 51; a longitudinal tube 52 suspending from a middle portion of a back surface of the top plate 51 and including a lower portion fitted around an outer circumference of an upper portion of the stem 30; and a nozzle 53 provided on the longitudinal tube 52 to protrude forward, the nozzle 53 including an open base end whose top portion in part constitutes the top plate 51, and the second member 50*b* including: a ring-shaped top plate portion 60; a vertical wall portion 61 suspending from an outer circumference of the top plate portion 60; a circumferential wall portion 62 suspending from an inner circumference of the top plate portion 60; a first fitting recess 63 provided in a front portion of the top wall portion 60 and the vertical wall portion 61; and a second fitting recess 64 provided along the inner circumference of the top plate portion 60 that is in contiguity with the first fitting recess 63, the first and the second member 50*a* and 50*b* being integrated by fitting the base end of the nozzle 53 to the first fitting recess 63 and fitting an outer circumference of the top plate 51 to the second fitting recess 64.

A second aspect of the present invention resides in the foam dispenser according to the first aspect, wherein a fitting hole 65 is provided in each of a bottom wall portion of the first fitting recess 63 and a bottom wall portion of the second fitting recess 64, and a hook 55 is provided to protrude from each of a lower surface of the nozzle 53 and a lower surface of the top plate 51 in correspondence with the fitting holes 65 so as to be hooked into the fitting holes 65, the fitting holes 65 and the hooks 55 together forming an engagement member.

A third aspect of the present invention resides in the foam dispenser of one of the first and the second aspect, wherein the second fitting recess 64 of the second member 50*b* is further recessed to form an annular drain recess 67 provided with a drain hole 68.

A fourth aspect of the present invention resides in the foam dispenser according to the third aspect, wherein the dispenser head 50 has a top surface constituted by the first and the second member 50*a* and 50*b*, the top surface being inclined downward from a front to a rear of the dispenser head 50, and the nozzle 53 and the bottom wall portion of the first fitting recess 63 and the bottom wall portion of the second fitting recess 64 are inclined downward from the front to the rear.

A fifth aspect of the present invention resides in the foam dispenser of any one of the first to fourth aspect, wherein a support plate 56 is provided to extend across an upper portion of the circumferential wall portion 62.

Advantageous Effects of Invention

According to the present invention, since the dispenser head 50 includes the two members, i.e., the first and the second member 50*a* and 50*b*, which include the above-mentioned unique structure, thicknesses of the first and the second member 50*a* and 50*b* are advantageously minimized, and the outlet and the dispenser passage can be enlarged while the conventional overall structure is maintained. Furthermore, the minimized thicknesses result in a reduced amount of material used, and moreover, the minimized thicknesses offer a manufacturing advantage that assembly of the first member and the second member 50*a* and 50*b* is significantly facilitated due to the structures thereof.

When the fitting hole 65 is provided in each of the bottom wall portion of the first fitting recess 63 and the bottom wall portion of the second fitting recess 64, and the hook 55 is provided to protrude from each of the lower surface of the nozzle 53 and the lower surface of the top plate 51 in correspondence with the fitting holes 65 so as to be hooked into the fitting holes 65, the fitting holes 65 and the hooks 55 together forming an engagement member, it is ensured that the first and the second member 50*a* and 50*b* are easily engaged.

When the second fitting recess 64 of the second member 50*b* is further recessed to form the annular drain recess 67 provided with the drain hole 68, even when water is permeated from where the two members constituting the dispenser head 50 are engaged, the permeated water can be discharged outside of the circumferential wall portion 62 from the drain hole 68. As a result, inconvenience, such as permeation of the water into the air cylinder 20 through the longitudinal tube 52, is prevented, for example.

When the dispenser head 50 has the top surface constituted by the first and the second member 50*a* and 50*b*, the top surface being inclined downward from the front to the rear of the dispenser head 50, and the nozzle 53 and the bottom wall portion of the first fitting recess 63 and the bottom wall portion of the second fitting recess 64 are inclined downward from the front to the rear, even when the water around the top surface of the dispenser head 50 is permeated from where an outer circumference of the top plate 51 and an inner circumference of the top plate portion 60 are joined, the water can flow rearward through the drain recess 67 to be smoothly discharged outside from the drain hole 68 at rear of the drain recess 67.

When the support plate 56 is provided to extend across the upper portion of the circumferential wall portion 62, stiffness of the dispenser head 50 formed in the minimized thickness is further increased, which further ensures that the risk of deformation and the like is prevented.

BRIEF DESCRIPTION OF DRAWINGS

The present invention will be further described below with reference to the accompanying drawings, wherein.

DESCRIPTION OF EMBODIMENTS

Embodiments of the present invention are described below with reference to the drawings.

Figure 1:
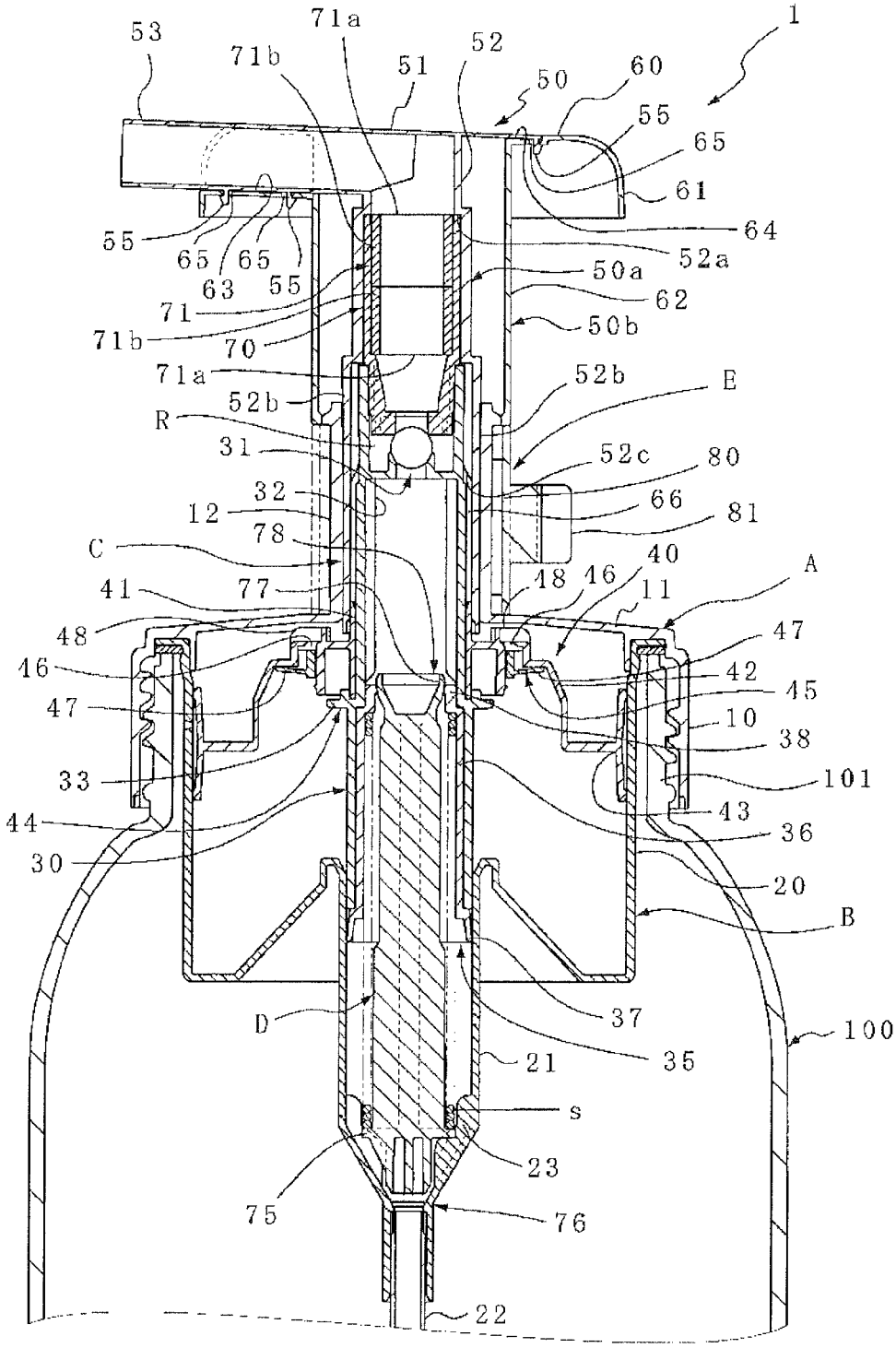
FIG. 1 is a longitudinal sectional view showing a foam dispenser according to a first embodiment.
Figure 2:
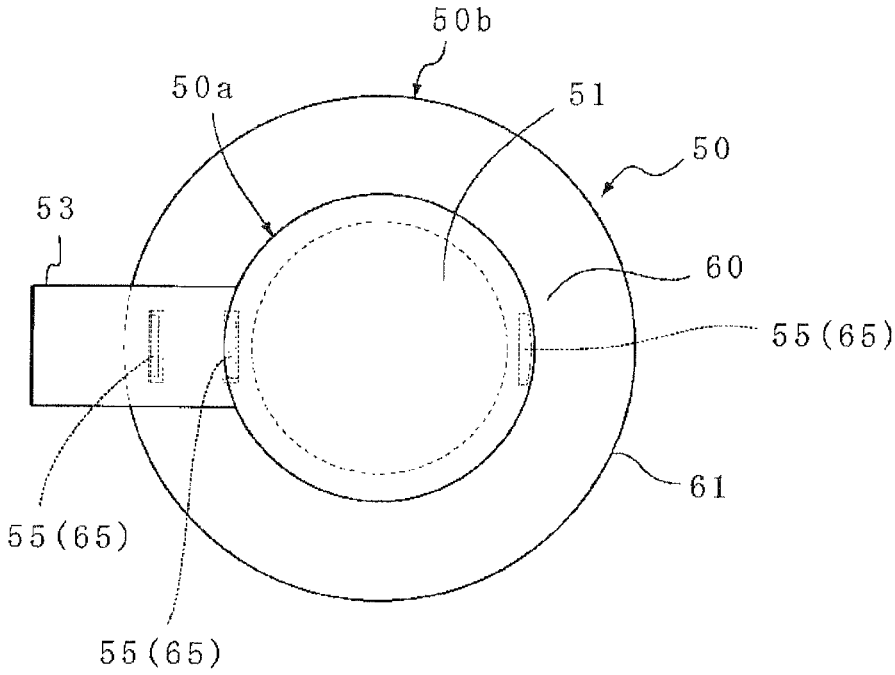
FIG. 2 is a plan view showing a dispenser head of the foam dispenser of the first embodiment.

FIGS. 1 and 2 show an example of a foam dispenser 1 including a placing cap A, a cylinder member B, an actuator C, a poppet valve body D, and a spacer E.

The placing cap A is used to fasten the foam dispenser 1 to a container body 100. The placing cap A includes a circumferential wall 10 having an upper edge fitted to an outer circumference of a neck 101 of the container body 100, a top wall 11 extending from the upper edge of the circumferential wall 10 and provided in a middle portion thereof with a window hole through which the actuator C extends, and a guide tube 12 extending upward from a circumferential portion of the window hole.

The cylinder member B includes a large-diameter air cylinder 20 having an upper end secured to a circumferential portion of a back surface of a top portion the placing cap A, along with a small-diameter liquid cylinder 21 extending concentrically with and below the air cylinder 20. The liquid cylinder 21 is configured to include a bottom wall portion whose front surface serves as a valve seat. The liquid cylinder 21 also includes an integrally-formed pipe fitting tube extending downward from a periphery of a central opening of the bottom wall portion. There is also provided a suction pipe 22 including an upper end fitted to the pipe fitting tube and a lower end suspended to reach a lower end portion of the container body 100. Furthermore, a plurality of engagement ribs 23 is projectingly provided circumferentially in a portion of an inner surface of the liquid cylinder 21 starting from a peripheral portion of the bottom wall portion and extending to a lower end portion of a circumferential wall portion of the liquid cylinder 21. Each engagement rib 23 includes an upwardly stepped portion in a middle portion between a top and a bottom of the engagement rib 23.

The actuator C is mounted to the cylinder member B such that the actuator C is urged upward and displaceable upward and downward. The actuator member C includes a stem 30, a liquid piston 35, an air piston 40, a dispenser head 50, and a tubular member 70.

The stem 30 has a tubular shape with open upper and lower ends. The liquid piston 35, which is adapted to slide in the liquid cylinder 35, is provided to protrude from the lower portion of the outer circumference of the stem 30. The air piston 40, which is adapted to slide in the air cylinder 20, is linked to an upper portion of the outer circumference of the stem 30. Thus, the stem 30 is provided to be displaceable upward and downward in the liquid cylinder 35 and in the air cylinder 20. Inside the stem 30 in an upper portion thereof, a dispenser valve 31 is provided, and a plurality of longitudinal ridges 32 is also provided circumferentially below the dispenser valve 31. Furthermore, on an outer surface of the stem 30, an air dispenser valve seat 33 is provided to protrude in a flange shape.

The liquid piston 35 includes a fitting tubular portion 36 fitted in a lower portion of the stem 30, and a sliding portion 37 in a skirt shape that protrudes outward from an outer circumference of a lower end of the fitting tubular portion 36, to with the sliding portion 37 slidably fitted to an inner circumference of the liquid cylinder 21 in a liquid-tight manner. The fitting tubular portion 36 forms, at an upper end portion thereof in a middle portion between the top and the bottom of the stem 30, a ridge-shaped check valve seat 38. There is also interposed a coil spring s between a lower surface of the fitting tubular portion 36 of the liquid piston 35 and the upwardly stepped portion of each engagement rib 23, so that the actuator C is constantly urged upward by the coil spring s.

The air piston 40 includes a tubular valve portion 41 provided in an inner circumference thereof and fitted to the outer circumference of the stem 30 so as to be gradually displaceable upward and downward, and a sliding portion 43 composed of an upper and a lower skirt-like portion and fitted to an inner circumference of the air cylinder 20, and a stepped wall portion 42 extending from an outer circumference of the tubular valve portion 41 to the sliding portion 43. The tubular valve portion 41 and the air dispenser valve seat 33 together form an air dispenser valve 44. The air dispenser valve 44 is closed when the actuator C is displaced to an uppermost position, opened when the actuator C is depressed down, and closed when the actuator C is displaced upward from the depressed position by the upward urging force. Furthermore, there is provided an outer-air introducing valve 45 in the stepped walled portion 42 of the air piston 40, for introducing an outer air. The outer-air introducing valve 45 includes a valve hole 46 pierced through the stepped wall portion 42 and a valve plate 47 pressed against the stepped wall portion 42, and when upward displacement of the depressed actuator C creates a negative pressure in the air cylinder 20, the outer-air introducing valve 45 is opened for introducing the outer air. The outer-air introducing valve 45 also includes a wall portion 48 standing on an upper surface of the stepped wall portion 42 except for an outer periphery of the valve hole 46, so the wall portion 48 prevents a liquid from permeating the air cylinder 20 even when the liquid is permeated through the guide tube 12.

The dispenser head 50 includes two members, i.e., a first member 50*a* and a second member 50*b*, that are easy to cut out with a die and can be formed in a small thickness during molding.

Figure 3:
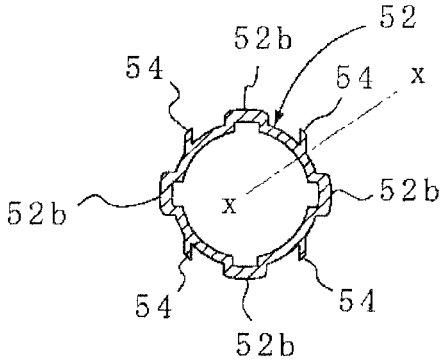
FIG. 3 is a cross-sectional view showing a longitudinal tubular portion of a first member of the first embodiment.
Figure 4:
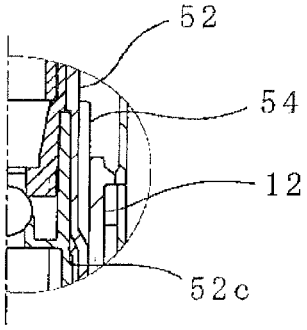
FIG. 4 is longitudinal sectional view showing part of the foam dispenser taken along a line x-x shown in FIG. 3 of the first embodiment.
Figure 5:
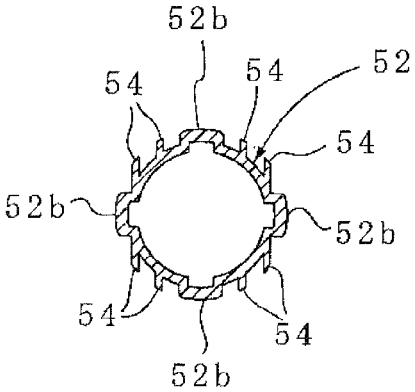
FIG. 5 is a cross-sectional view showing the longitudinal tubular portion of the first member according to a second embodiment.

The first member 50*a* includes a top plate 51, a longitudinal tube 52 suspending from a middle portion of a back surface of the top plate 51 and fitted around an outer circumference of an upper portion of the stem 30, and a nozzle 53 provided on the longitudinal tube 52 to protrude forward and including an open base end. A top portion of the base end of the nozzle 53 in part constitutes the top plate 51. The longitudinal tube 52 includes, in an upper portion thereof, a large-diameter first stepped portion 52*a*, and also includes, in a middle portion between a top and a bottom thereof, a plurality of elongated strip-shaped protrusions 52*b* circumferentially arranged to bulge out. Each strip-shaped protrusion 52*b* protrudes such that an outer surface of the strip-shaped protrusion 52*b* is in proximity to an inner surface of the guide tube 12. The longitudinal tube 52 also includes a second stepped portion 52*c* extending from a lower end portion of each strip-shaped protrusion 52*b*, the second stepped portion 52*c* having an even larger diameter. Furthermore, there is provided a plurality of ribs 54 protruding from an outer surface of the longitudinal tube 52 between adjacent strip-shaped protrusions 52*b*. In the present embodiment, as shown in FIG. 3, one rib 54 protrudes between each strip-shaped protrusion 52*b*, and as shown in FIG. 4, an outer edge of the rib 54 is in proximity to the inner surface of the guide tube 12. Note that the number of the ribs 54 is not limited to the present embodiment, and two or another number of ribs 54 may be protruded between each strip-shaped protrusion 52*b* as shown in FIG. 5. Furthermore, the number of strip-shaped protrusions 52*b* is not limited to four as illustrated in the figures. Moreover, there is provided a hook 55 protruding from each of a lower surface of the nozzle 53 and a lower surface of the top plate 51.

The second member 50*b* includes a ring-shaped top plate portion 60, a vertical wall portion 61 suspending from an outer circumference of the top plate portion 60, and a circumferential wall portion 62 suspending from an inner circumference of the top plate portion 60. Furthermore, the second member 50*b* includes, for fitting the base end of the nozzle 53, a first fitting recess 63 in a front portion the second member 50*b*, and also includes, for fitting an outer circumference of the top plate 51, a second fitting recess 64 in contiguity with first fitting recess 63. Accordingly, the first fitting recess 63 has a linear shape with a large longitudinal width, and the second fitting recess 64 has a substantially annular shape with a longitudinal width as small as a material thickness. Furthermore, the second member 50*b* includes a fitting holes 65 in each of a bottom wall portion of the first fitting recess 63 and a bottom wall portion of the second fitting recess 64 that correspond to the hooks 55 when the second member 50*b* is fitted to the first member 50*a*, and the fitting holes 65 and the hooks 55 together form an engagement member.

The first and the second member 50*a* and 50*b* are fixedly fitted to each other, with each hook 55 engaged in the corresponding engagement hole 65, and thus the dispenser head 50 is formed. Furthermore, the tubular member 70 as a partition wall having a small-diameter tower portion is fitted below the first stepped portion 52*a* of the dispenser head 50 so as to fit a lower portion of the longitudinal tube 52 around the outer circumference of the upper portion of the stem 30. The air cylinder 20 and the stem 30 are in communication via an air passage 66 that passes between the stem 30 and the longitudinal tube 52 to communicate with an inside of the stem 30 below the tubular member 70, and a gas-liquid mixing chamber R is defined between the tubular member 70 and the dispenser valve 31. Furthermore, a lower end of the circumferential wall portion 62 is suspended to a position of an upper end portion of an outer circumference of the guide tube 12 such that a ridged end face of the circumferential wall portion 62 abuts against or is in proximity to a ridged end face of the guide tube 12. In the dispenser head 50, a top surface constituted by the first and the second member 50*a* and 50*b* is inclined downward from front to rear, and accordingly, the entire nozzle 53 is similarly inclined. The bottom wall portion of the first fitting recess 63 and the bottom wall portion of the second fitting recess 64 are also similarly inclined.

In a downstream of the gas-liquid mixing chamber R, a forming member 71 is provided. The foaming member 71 in the present embodiment includes a pair of tubular bodies 71*b* in which meshes 71*a* are stretched, and the foaming member 71 is fitted in the tubular member 70 such that the meshes 71*a* are arranged on top and bottom.

The poppet valve body D has a length extending from an inside of the liquid cylinder 21 to the stem 30 and includes a plurality of engagement protrusions 75 circumferentially provided in a lower end portion of an outer circumference thereof. One engagement protrusions 75 is positioned between each engagement rib 23 of the liquid cylinder 21. A circumference of a lower surface of each engagement protrusion 75 is tapered so as to form a suction valve 76 in cooperation with a suction valve seat formed by a bottom surface of the liquid cylinder 21. The poppet valve body D is displaceable upward and downward from a position where the lower surface abuts against the suction valve seat to a position where each engagement protrusion 75 abuts against a lower surface of the coil spring s. The poppet valve body D also includes, at a top thereof, a check valve body 77 spreading in a tapered tubular shape, and the check valve body 77 and the check valve seat 38 together form a check valve 78.

The spacer E includes a fitting portion 80 of a circular-arc plate shape detachably fitted to the outer circumference of the guide tube 12, and a knob portion 81 of a plate shape protruding rearward from a rear surface of the fitting portion 80. When fitted, the fitting portion 80 of the spacer E abuts against a lower surface of the circumferential wall portion 62 of the dispenser head 50 so as to prevent the actuator C from being depressed. The fitting portion 80 is forced to be fitted to the outer circumference of the guide tube 12 by elastically spreading the fitting portion 80.

From the state of the foam dispenser 1 shown in FIG. 1, by removing the spacer E and depressing the dispenser head 50, the air piston 40 is displaced upward relative to the stem 30, and the air dispenser valve 44 is opened. As the air piston 40 is displaced downward, an air inside the air cylinder 20 is pressurized to be introduced into the gas-liquid mixing chamber R via the air passage 66. On the other hand, the stem 30 is depressed downward, thereby displacing the poppet valve body D downward until the poppet valve body D comes into abutment against the suction valve seat. As the poppet valve body D is displaced upward relative to the stem 30 and the check valve 78 is opened, a pressurized liquid inside the liquid cylinder 21 is introduced into the gas-liquid mixing chamber R via the dispenser valve 31. The air and the liquid are mixed in the gas-liquid mixing chamber R. In this regard, the poppet valve body D is displaced upward relative to the stem 30 while the check valve body 77 of the poppet valve body D is in sliding contact with an inner surface of each longitudinal ridge 32 of the stem 30. The mixed gas and liquid in the gas-liquid mixing chamber R passes through the foaming member 71 to be foamed and dispensed from the nozzle 53 as foam.

When the dispenser head 50 is released, the actuator C is displaced upward by the upward urging force of the coil spring s. At this time, the air piston 40 is displaced downward relative to the stem 30 to close the air dispenser valve 44, thereby creating the negative pressure in the air cylinder 20. As a result, the outer air introducing valve 45 is opened, and the outer air is introduced into the air cylinder 20. On the other hand, upward displacement of the stem 30 displaces the poppet valve body D upward by a friction force generated between the check valve body 77 and each longitudinal ridge 32. As a result, the suction valve 76 is opened, and the liquid within the container body 100 is introduced into the liquid cylinder 21 under the negative pressure, while the dispenser valve 31 is closed. The poppet valve body D is displaced upward until the engagement protrusions 75 thereof come into abutment with the lower surface of the coil spring s and subsequently displaced downward relative to the stem 30 until the check valve body 77 comes into abutment with the check valve seat 38.

Figure 6:
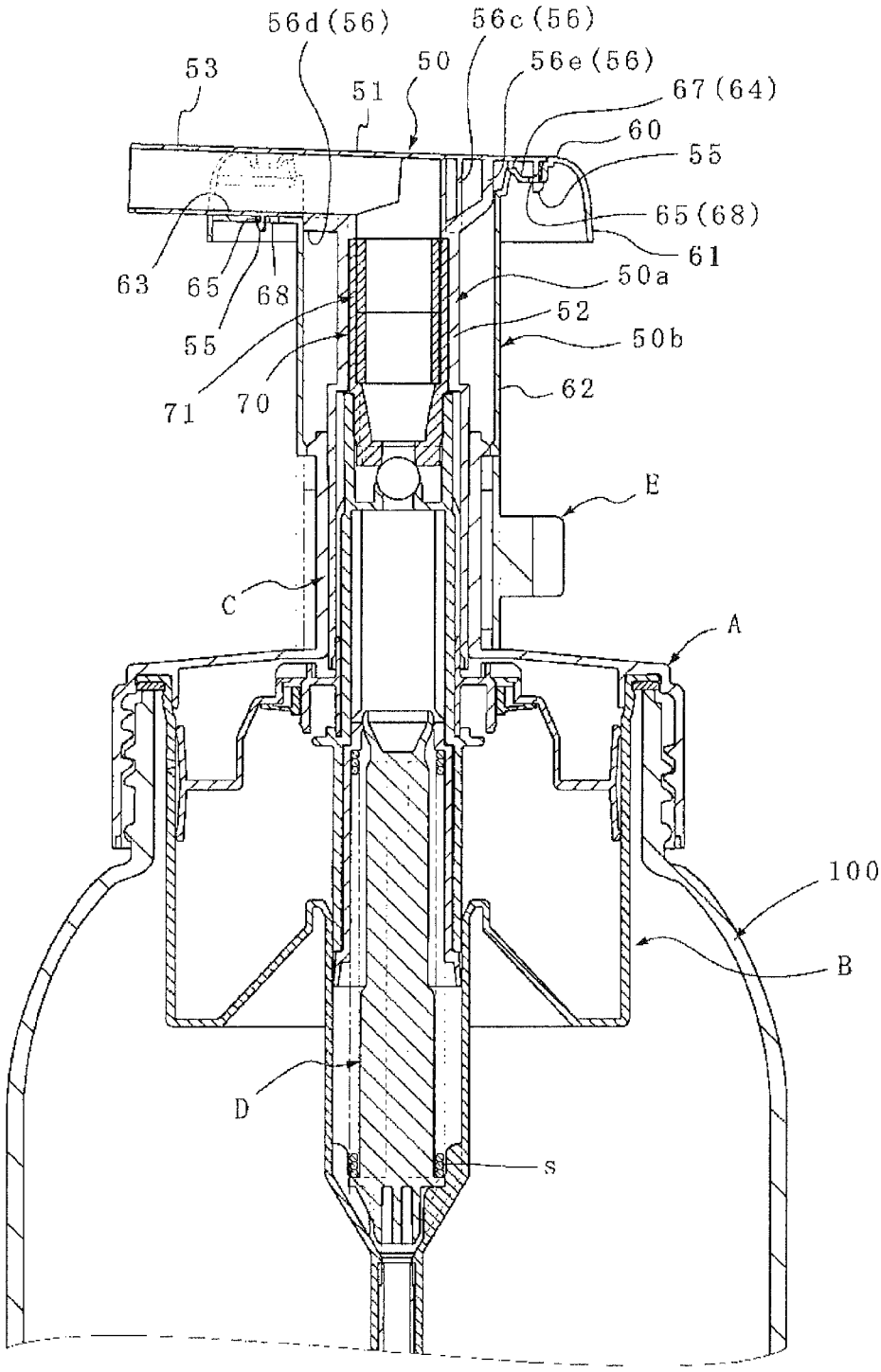
FIG. 6 is a longitudinal sectional view showing the foam dispenser according to a third embodiment.
Figure 7:
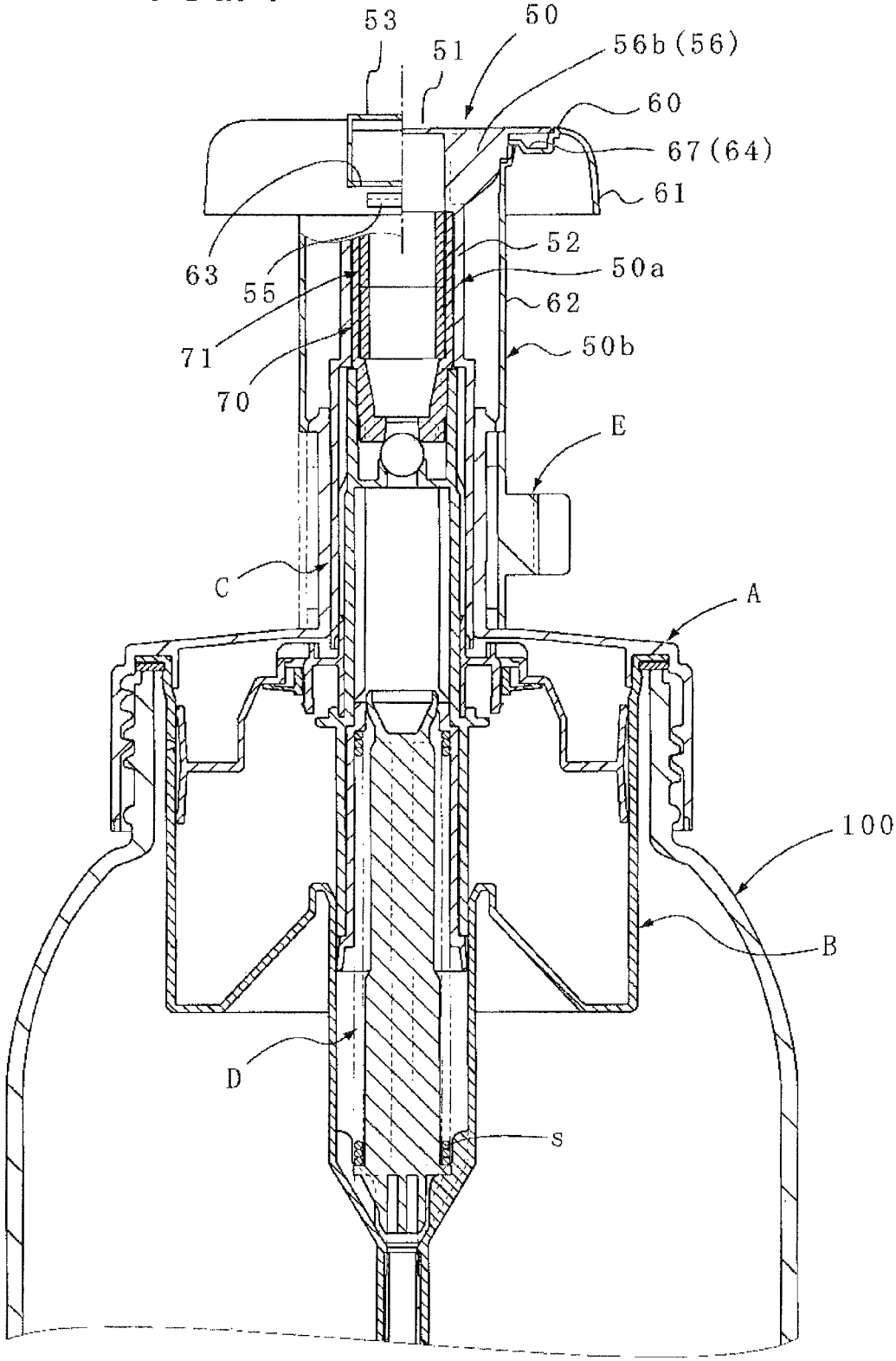
FIG. 7 is a longitudinal sectional view showing the foam dispenser of the third embodiment.
Figure 8:
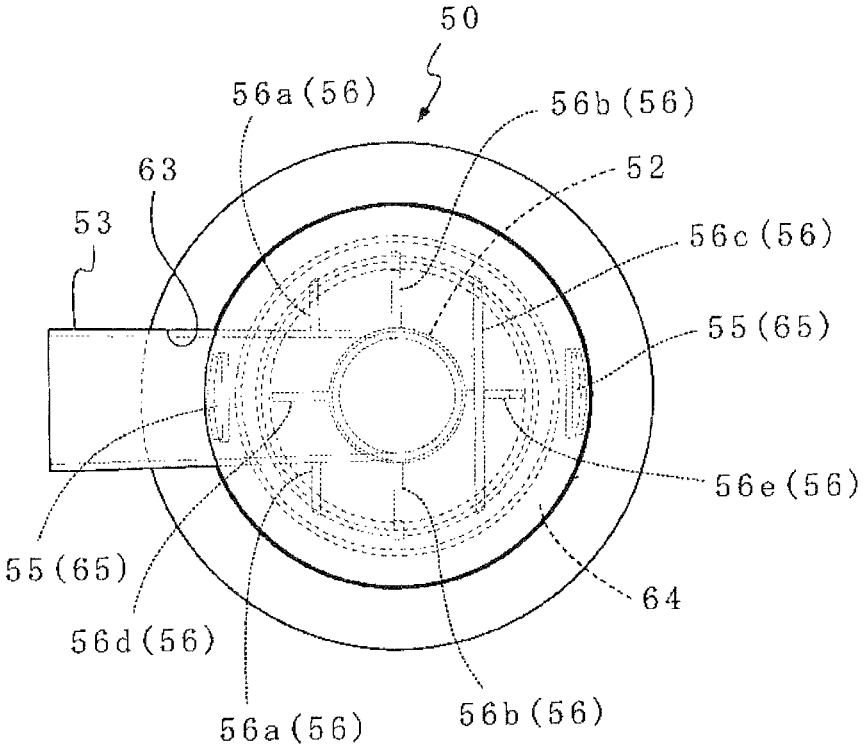
FIG. 8 is a plan view showing the dispenser head of the foam dispenser of the third embodiment.

FIGS. 6-8 show another embodiment in which the second fitting recess 64 of the second member 50*b* in the embodiment shown in FIG. 1 is further recessed to form an annular drain recess 67 provided with a drain hole 68. In the present embodiment, the fitting hole 65 doubles as the drain hole 68. Furthermore, the first fitting recess 63 is provided with the drain hole 68 as well. The drain holes 68 of the first and the second fitting recess 63 and 64 may be independently provided. In this case also, the top surface of the dispenser head 50 that is constituted by the first and the second member 50*a* and 50*b* is inclined downward from front to rear, and the lower surface of the nozzle 53 is also inclined from front to rear. Accordingly, the bottom surfaces of the first and the second fitting recess 63 and 64, as well as a lower surface of the drain recess 67, are inclined from front to rear.

Moreover, there are provided support plates 56 in an upper portion of the circumferential wall portion 62, for providing support. As shown in FIG. 8, the support plates 56 in the illustrated embodiment include a front-part lateral support plate 56*a* protruding from left and right sides of the base end of the nozzle 53 in a lateral direction, an intermediate-part lateral support plate 56*b* protruding from the left and right sides of the longitudinal tube 52 in the lateral direction, a rear-part lateral support plate 56*c* extending downward from the top plate 51 in rear of the longitudinal tube 52 with a space therebetween, a front-part longitudinal support plate 56*d* protruding forward from a front portion of the longitudinal tube 52 on the bottom surface of the nozzle 53, and a rear-part longitudinal support plate 56*e* of a substantially L-shape protruding rearward from a rear portion of the longitudinal tube 52 and then bent upward to be coupled to the top plate 51. In this instance, the terms "lateral" and "longitudinal" in connection with these support plates 56*a*-56*e* refer, respectively, to the lateral and longitudinal directions of the nozzle 53 itself. The rear-part longitudinal support plate 56*e* is also coupled to the rear-part lateral support plate 56*c*. The support plates 56 are integrally formed with the first member 50*a* and are extended across the circumferential wall portion 62 such that the support plates 56 are fixed at outer peripheries thereof to opposing sides of the circumferential wall portion 62 by pressure contact, engagement, and the like. It is suffice to provide at least one of the support plates 56, and a shape and a position thereof may be determined according to a desired stiffness. Other structures are similar to those of the embodiment shown in FIG. 1, and a description thereof is omitted here. Furthermore, the support plates 56 may be extended between the circumferential wall portion 62 and the vertical wall portion 61.

Meanwhile, the aforementioned members are mainly made of synthetic resin, and a metal, a flexible elastomer, and the like may also be used in combination as appropriate.

REFERENCE SIGNS

1 Foam dispenser
A Placing cap
10 Circumferential wall
11 Top wall
12 Guide tube
B Cylinder member
20 Air cylinder
21 Liquid cylinder
22 Pipe
23 Engagement rib
C Actuator
30 Stem
31 Dispenser valve
32 Longitudinal ridge
33 Air dispenser valve seat
35 Liquid piston
36 Fitting tubular portion
37 Sliding portion
38 Check valve seat
40 Air piston
41 Tubular valve portion
42 Stepped wall portion
43 Sliding portion
44 Air dispenser valve
45 Outer-air introducing valve
46 Valve hole
47 Valve plate
48 Wall portion
R Gas-liquid mixing chamber
50 Dispenser head/First member
51 Top plate
52 Longitudinal tube
52*a* First stepped portion
52*b* Strip-shaped protrusion
52*c* Second stepped portion
53 Nozzle
54 Rib
55 Hook
56 Support plate
56*a* Front-part lateral support plate
56*b* Intermediate-part lateral support plate
56*c* Rear-part lateral support plate
56*d* Front-part longitudinal support plate
56*e* Rear-part longitudinal support plate
50*b* Second member
60 Top plate

61 Vertical wall portion
62 Circumferential wall portion
63 First fitting recess
64 Second fitting recess
65 Fitting hole
66 Air passage
67 Drain recess
68 Drain hole
70 Tubular member
71 Foaming member
71*a* Mesh
71*b* Tubular body
D Poppet valve body
75 Engagement protrusion
76 Suction valve
77 Check valve body
78 Check valve
E Spacer
80 Fitting portion
81 Knob portion
S Coil spring
100 Container body
101 Neck

The invention claimed is:

1. A foam dispenser, comprising:

a cylinder member that includes: an upper end portion adapted to be secured to a placing cap fitted over an outer circumference of a neck of a container body so that the cylinder member is suspended in the container body; a large-diameter air cylinder; and a small-diameter liquid cylinder provided concentrically with and below the large-diameter air cylinder; and an actuator that includes: a stem; a liquid piston protruding from a lower portion of an outer circumference of the stem and adapted to slide in the liquid cylinder; an air piston linked to the outer circumference of the stem and adapted to slide in the air cylinder; and a dispenser head fitted over an upper end of the stem, the actuator being urged upward and adapted to be displaceable upward and downward such that the upward and the downward displacement of the actuator causes a liquid within the liquid cylinder and air within the air cylinder to be mixed and foamed to be dispensed as a foam from an outlet of the dispenser head, wherein the dispenser head comprises two members in the form of a first member and a second member, the first member including: a top plate; a longitudinal tube suspending from a middle portion of a back surface of the top plate and including a lower portion fitted around an outer circumference of an upper portion of the stem; and a nozzle provided on the longitudinal tube to protrude forward, the nozzle including an open base end whose top portion in part constitutes the top plate, and the second member including: a ring-shaped top plate portion; a vertical wall portion suspending from an outer circumference of the top plate portion; a circumferential wall portion suspending from an inner circumference of the top plate portion; a first fitting recess provided in a front portion of the top wall portion and the vertical wall portion; and a second fitting recess provided along the inner circumference of the top plate portion that is in contiguity with the first fitting recess, the first and the second member being integrated by fitting the base end of the nozzle to the first fitting recess and fitting an outer circumference of the top plate to the second fitting recess.

2. The foam dispenser of claim 1, wherein a support plate is provided to extend across an upper portion of the circumferential wall portion.

3. The foam dispenser of claim 1, wherein the second fitting recess of the second member is further recessed to form an annular drain recess provided with a drain hole.

4. The foam dispenser of claim 3, wherein a support plate is provided to extend across an upper portion of the circumferential wall portion.

5. The foam dispenser of claim 3, wherein the dispenser head has a top surface constituted by the first and the second member, the top surface being inclined downward from a front to a rear of the dispenser head, and the nozzle and the bottom wall portion of the first fitting recess and the bottom wall portion of the second fitting recess are inclined downward from the front to the rear.

6. The foam dispenser of claim 5, wherein a support plate is provided to extend across an upper portion of the circumferential wall portion.

7. The foam dispenser of claim 1, wherein a fitting hole is provided in each of a bottom wall portion of the first fitting recess and a bottom wall portion of the second fitting recess, and a hook is provided to protrude from each of a lower surface of the nozzle and a lower surface of the top plate in correspondence with the fitting holes so as to be hooked into the fitting holes, the fitting holes and the hooks together forming an engagement member.

8. The foam dispenser of claim 7, wherein a support plate is provided to extend across an upper portion of the circumferential wall portion.

9. The foam dispenser of claim 7, wherein the second fitting recess of the second member is further recessed to form an annular drain recess provided with a drain hole.

10. The foam dispenser of claim 9, wherein a support plate is provided to extend across an upper portion of the circumferential wall portion.

11. The foam dispenser of claim 9, wherein the dispenser head has a top surface constituted by the first and the second member, the top surface being inclined downward from a front to a rear of the dispenser head, and the nozzle and the bottom wall portion of the first fitting recess and the bottom wall portion of the second fitting recess are inclined downward from the front to the rear.

12. The foam dispenser of claim 11, wherein a support plate is provided to extend across an upper portion of the circumferential wall portion.

* * * * *